United States Patent [19]

Harris

[11] Patent Number: 4,519,643

[45] Date of Patent: May 28, 1985

[54] HANDLE FOR EXTENDING THE REACH OF A ROPE

[76] Inventor: Warren R. Harris, 1960 Dolphin Blvd. S., St. Petersburg, Fla. 33707

[21] Appl. No.: 587,908

[22] Filed: Mar. 9, 1984

[51] Int. Cl.[3] ..... B63B 21/04

[52] U.S. Cl. ..... 294/19.1; 114/221 R

[58] Field of Search ..... 294/19 R, 19 A, 20, 294/22, 23, 24, 66 R, 1 R, 99 R; 114/221 R, 230

[56] References Cited

U.S. PATENT DOCUMENTS

| | | | |
|---|---|---|---|
| 3,841,685 | 10/1974 | Kolodziej | 294/19 R |
| 3,878,808 | 4/1975 | Mock, Jr. | 114/221 R |
| 4,105,239 | 8/1978 | Akczinski, Sr. | 294/19 R |

*Primary Examiner*—James B. Marbert

*Attorney, Agent, or Firm*—Walter J. Monacelli

[57] ABSTRACT

The rope handling device described herein comprises two cylindrical tubes adapted to have one pass longitudinally within the other, with a T or Y shaped journal attached to the end of the outer tube. An appropriate length of rope is positioned through the length of the inner tube and the rope is looped at the end extending out of the tubes and through a spreading journal or yoke, one portion of the loop extending out one side of the journal and another part extending out the other side of the journal and the completion of the loop extending out beyond the journal. The loop section of the rope has a stiffening means, such as a stiff spring wire embedded and securely fastened in the rope. The loop may be enlarged by pushing the rope through the spreader. The loop may be made smaller and tightened on any object encircled by the loop by pulling the rope through the tubes. By pulling the inner tube away from the loop the overall length of tubes may be expanded to a considerable length to permit positioning the loop over an object a considerable distance from the holder and is particularly adapted therefore to fastening boats to mooring posts.

6 Claims, 8 Drawing Figures

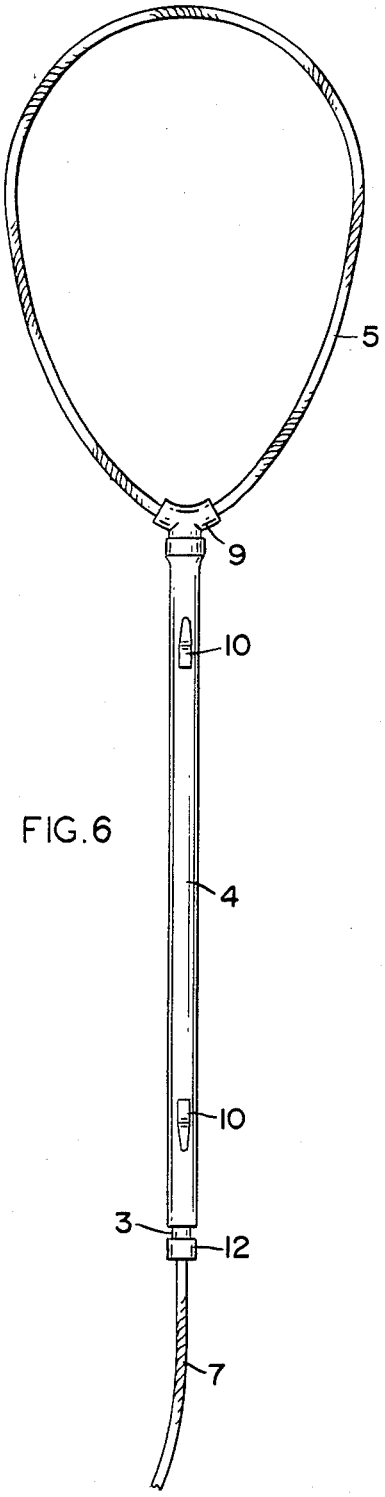
FIG. 6
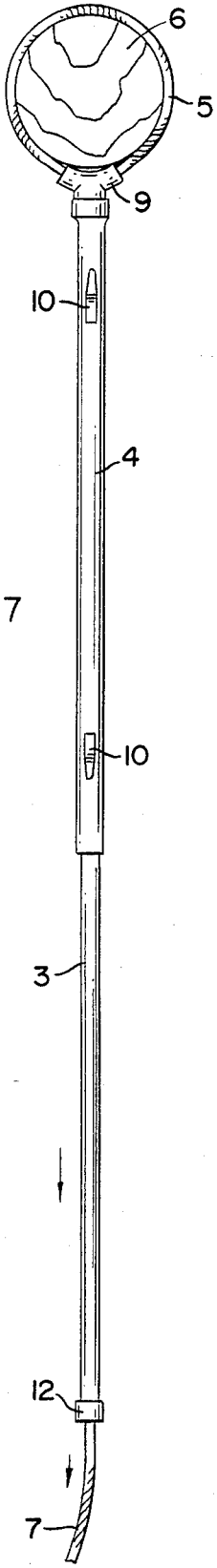
FIG. 7
FIG. 8
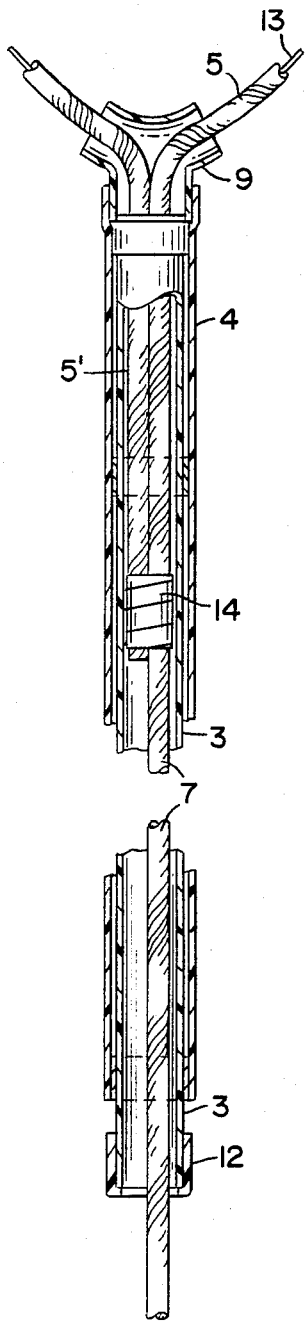

HANDLE FOR EXTENDING THE REACH OF A ROPE

BACKGROUND OF THE INVENTION

1. Field of the Invention

This invention relates to an apparatus for applying a rope loop to various objects at a considerable distance from the holder of the rope, such as mooring posts or cleats on a mooring dock. More specifically, it relates to a rope loop enlarging device which allows a large firm loop to be formed and then extended to considerable distance to reach and encircle a mooring device. Still more specifically, it relates to such a loop enlarging device which has a telescoping length which permits the rope to be pulled through its interior to effect a tightening of the loop.

2. Description of the Prior Art

A number of noose tightening devices are known such as described in U.S. Pat. Nos. 1,569,496; 1,661,064; 1,713,624; 1,883,598 and 3,540,769. These are all designed to ensnare animals. While these disclose a rope which is pulled through a tube to tighten the noose, none of these are designed to permit enlarging the noose from a distance nor are there any telescoping tubes shown which permit the holder to ensnare an object from a considerable distance.

It is an object of this invention to design a device which permits enlarging a rope loop and extending it a considerable distance to encircle an object such as a mooring post.

It is also an object of this invention to facilitate the attachment of a soft pliable and resilient rope, such as nylon rope, to an object beyond normal reach.

It is also an object of this invention to stiffen the rope in the loop forming and manipulating portion while leaving the remainder of the rope naturally resilient.

It is also an object of this invention to use one continuous piece of rope to reach a distant object, such as a piling, from a boat.

Various other objectives are attained as described hereinafter.

SUMMARY OF THE INVENTION

In accordance with the present invention, a rope loop enlarging and tightening apparatus has been designed which permits these functions to be effected by the holder at a considerable distance from the object to be encircled. This apparatus is particularly useful in fastening boats to mooring objects, such as posts or pilings, while the boat and the mooring post or piling may be at a considerable distance from each other. This apparatus comprises two cylindrical tubes, one of which fits inside the other with a rope extending through the interior and the length of the tubes. One end of this rope is looped and the resultant loop passes through a T or Y shaped spreader journal or yoke attached to the end of the outer tube. The rope is actually passed first through one of the spreader openings, then looped around and through the other spreader opening after which the end of the rope is spliced or otherwise fastened to the rope to complete the loop. Then the spreader is attached to the outer tube. The loop is enlarged by pushing the stiffened portion of the rope through the tubes toward the looped end. The portion of the loop outside the tubes is decreased in size by pulling the rope away from the looped end. These movements are effected by various means as described hereinafter.

At least the loop portion of the rope and preferably the length of rope that reaches through the tubes has a stiffening means, such as a stiff but flexible wire embedded and securely fastened in the rope. This helps the loop to keep its shape and also is important in pushing the rope through the tubes to enlarge the loop. With the loop enlarged the inner tube may be pulled out a considerable distance from inside the outer tube, thereby increasing the overall length of the apparatus. This permits the loop to be positioned a considerable distance from the holder and when desired over a post, mooring pole or other object to be encircled.

The movement of the rope through the tubes in a direction toward the loop so as to enlarge the loop may be effected by several means. When the rope is stiffened through the full length of the tube, this movement of the rope may be effected merely by holding the rope in the hand and moving it toward the looped end. Generally the inner tube is in its fully extended position for this purpose and both the inner tube and the rope may be moved into the interior of the outer tube.

Another means for moving the rope into a loop enlarging position is to have a washer on the rope which has an outer diameter sufficient to fit into the outer tube but not into the inner tube. The inner diameter of the washer is large enough to fit around the rope but not over the juncture or splicing of the rope end where it forms the loop. In this manner pushing the inner tube further into the outer tube will force the washer against the juncture of the loop and push it through the spreader to an enlarged portion beyond the spreader. Then the inner tube may be withdrawn through a substantial portion of the outer tube thereby giving a maximum overall length to the combined tubes.

After the enlarged loop is used to encircle a mooring pole, post or other object, the rope is pulled to tighten the loop on the object. Then the inner tube may be pushed into the outer tube to shorten the overall length and the rope wound around or tied to a mooring bit or cleat on the boat deck, etc.

The inner tube may have an enlarged portion or stop reaching a small distance around its outer circumference positioned about 4–6 inches or more from the inner end thereof and adapted to fit into a notched portion of a lip extending over the end of the outer tube through which the inner tube will slide. This lip extends inwardly toward the interior of the tube but not to an extent that the inner tube may be prevented from sliding into the outer tube. This lip may actually be a portion of a cap fitting on and attached to the end of the outer tube. By rotating the inner tube on its linear axis until the stop is opposite the notched portion of this lip, the stop may be passed beyond the notched portion of the lip. Then by again rotating the inner tube in either direction and then pushing the inner tube toward the interior of the outer tube, this stop may be pressed against the unnotched portion of the lip so as to prevent further entry of the inner tube into the outer tube. In place of this lip there may be a raised portion extending partially around the inner surface of the outer tube near the end thereof whereby the stop on the inner tube will act as on the notched lip described above. In this locked position the combination of tubes may be used for pushing purposes in their extended overall length. Then by rotating again to match the stop to the notch in the lip portion the inner tube may again be telescoped into the outer tube.

DETAILED DESCRIPTION OF THE INVENTION

The description of the apparatus of this invention may be facilitated by reference to the drawings in which:

FIG. 6 is a front elevational view of another modification of the apparatus of this invention with loop enlarged and the tubes telescoped to their shortest length.

FIG. 7 is a front elevational view of the apparatus of FIG. 6 with the loop tightened and the tubes extended to full length.

FIG. 8 is a partial cross-sectional view showing the interior construction.

Figure 1:
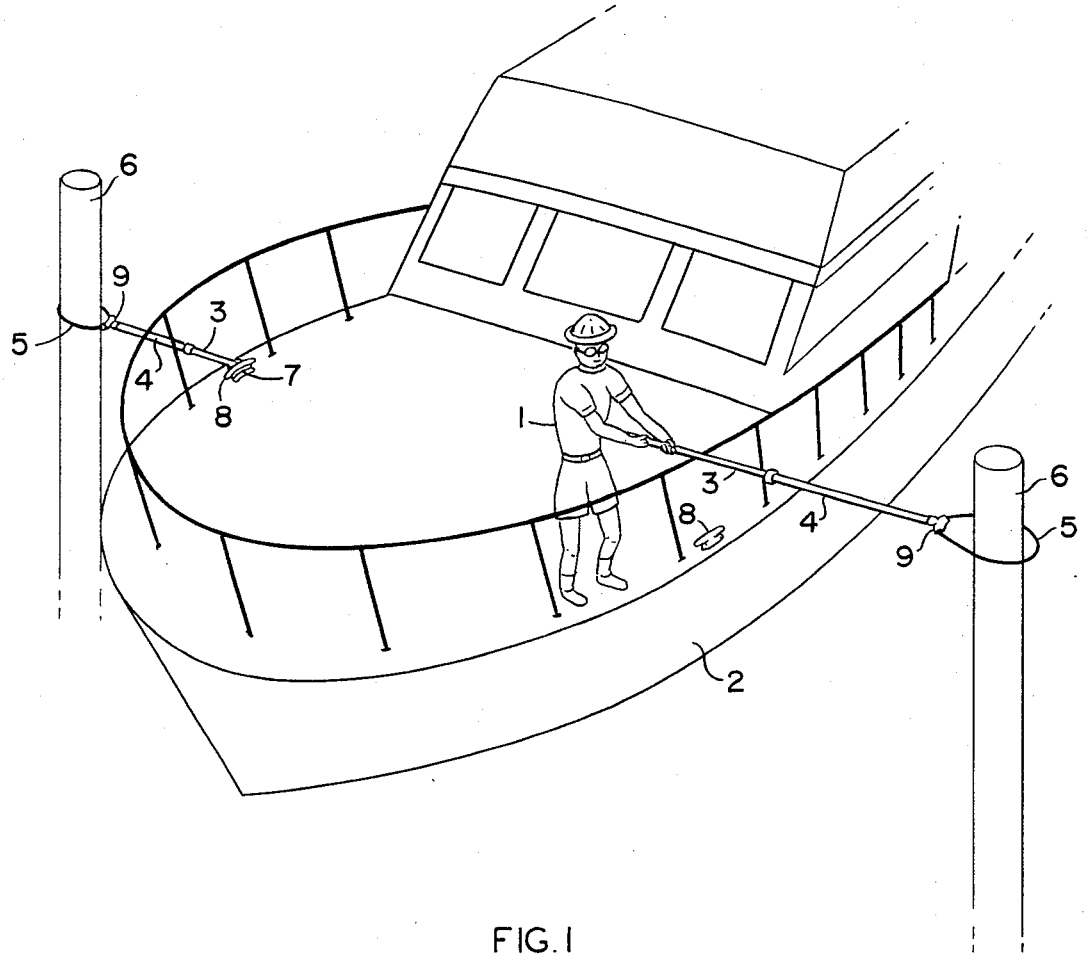
FIG. 1 is a perspective view of a boat crewman holding the device of this invention in its full length position with loop enlarged and encircling a piling.

In FIG. 1, crewman 1 is standing on boat 2 holding the rope handling device with inner tube 3 and outer tube 4 in their fully extended overall position with loop 5 enlarged and positioned over piling 6. The loop enters spreader 9 before entering tube 4. On the other side of the boat a similar device is shown in retracted or shortened position with the loop 5 tightened onto piling and the opposite end of the rope 7 wrapped around fastening means 8.

Figure 2:
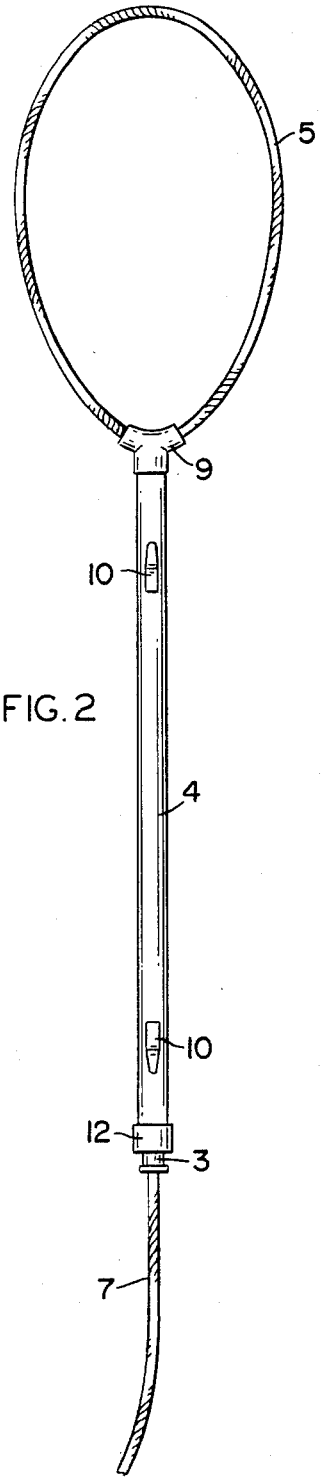
FIG. 2 is a front elevational view of this apparatus with loop enlarged and the tubes telescoped to their shortest overall length.

In FIG. 2, the loop 5 is shown in enlarged position and inner tube 3 is fully inserted into outer tube to give the device its shortened length. The loop 5 passes through spreading yoke 9. Brackets 10 are provided for storage of the rope when not in use.

Figure 3:
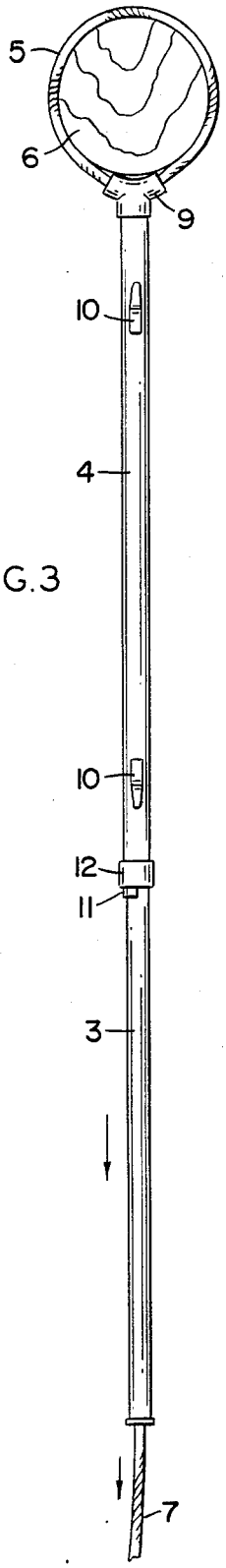
FIG. 3 is a front elevational view of the apparatus of FIG. 2 with the loop tightened and the tubes extended to full length.

FIG. 3 shows the loop 5 in retracted position tightened on piling 6 with inner tube 3 in fully extended position and stop 11 pressing against lipped cap 12 in locked position.

Figure 4:
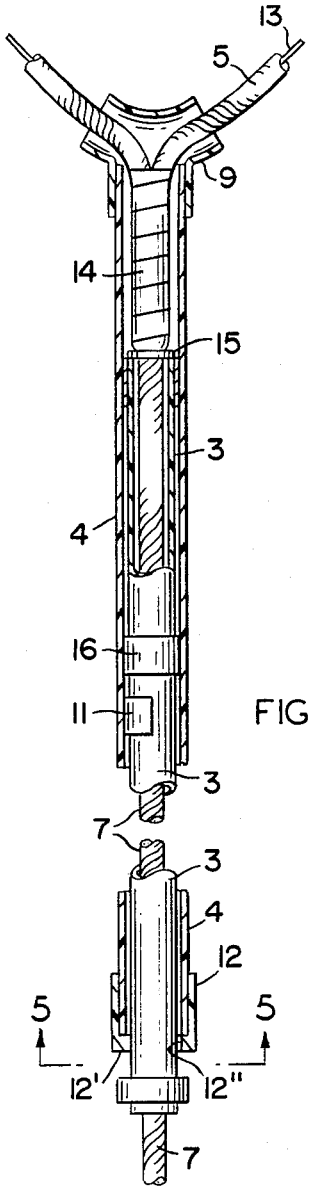
FIG. 4 is a partial cross-sectional view of the apparatus as shown in FIG. 2.

FIG. 4 is cross-sectional to show the interior construction. The loop 5 has stiffening wire 13 embedded therein. This wire may extend only in the loop portion but preferably extends through the rope portion inside the tubes in their retracted position. The spliced loop section 14 has a diameter greater than the inside diameter of washer 15 so that tube 3 will press against the washer 15 and thereby spliced loop section 14 when tube 3 is pushed inside tube 4. Stop 11 may be passed through a notched portion (not shown) in lipped cap 12 when tube 3 is substantially but partially withdrawn from the interior of tube 4. Spirally wrapped strands 7' comprise rope 7. Stabilizer bushing 16 prevents wobbling because of the space between the interior of tube 4 and the exterior of tube 3, and also stops tube 3 from being withdrawn past the lip 12'.

Figure 5:
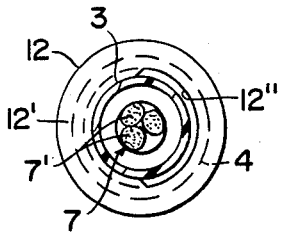
FIG. 5 is cross-sectional view taken at line 5—5 of FIG. 4.

FIG. 5 shows a cross-sectional view of the apparatus shown in FIG. 4 taken at line 5—5.

FIGS. 6, 7 and 8 show another modification of the apparatus of this invention showing the rope to form loop 5 joined by having the loop end 5' taped instead of spliced to rope 7. In this case there is no washer as shown in FIG. 4 and instead the stiffness of rope 7 inside the tubes is relied on for pushing the loop to an enlarged position.

Other obvious modifications are contemplated and are included in the scope of this invention.

The tubes 3 and 4 may be of various lengths depending on the particular purposes to be served. Generally lengths of 3–8 feet or more for each tube are suitable giving lengths in extended position of 5–15 feet or more.

Moreover means other than those described above may be used as stopping devices to give rigidity when it is desired to use the apparatus as a pushing device.

It is also contemplated that there may be three tubes used instead of two with appropriate diameters so that another tube may be inserted interior to the inner tube described above. In that way the tubes may be telescoped to a shorter length than possible with two tubes or in the alternative may be used to give a greater extended length than possible with two tubes.

The tubes may be made of any convenient material such as aluminum or other lightweight metal but preferably are made of plastic such as polyvinylchloride (PVC).

It is also contemplated that stiffening means other than the wire arrangement described may be used. For example the loop and adjacent rope section may be coated with an appropriate stiffening agent to impart the desired degree of stiffness. Or where appropriate, the stiffening means may be inherent stiffness in the rope itself.

While certain features of this invention have been described in detail with respect to various embodiments thereof, it will of course be apparent that other modifications can be made within the spirit and scope of this invention and it is not intended to limit the invention to the exact details shown above except insofar as they are defined in the following claims.

The invention claimed is:

1. A device for enlarging a rope loop and extending it a substantial distance from the holder to encircle an object comprising:

(a) a first tube having a Y or T shaped separator tubular yoke attached to one end thereof;

(b) a second tube having a diameter smaller than the exterior diameter of said first tube and adapted to fit into said first tube;

(c) a rope extending into said second tube while said second tube is inserted inside said first tube, and passing into said separator yoke with the end of said rope passed through one opening of said separator yoke, looped to pass through the other opening of said yoke and into the said first tube where it is attached to said rope to complete the loop which passes from and back into the interior of said first tube; and (d) a means for stiffening said loop, said stiffening means extending in the rope no further than the length of the said first tube.

2. The device of claim 1 in which said stiffening means comprises a flexible but stiff wire embedded and securely fastened in the interior of the rope loop.

3. The device of claim 2 in which said stiff wire extends through the rope to a length approximately equivalent to the length of the first tube.

4. The device of claim 1 in which said first tube has a partial barrier on the inside thereof and the second tube has a stop on the outside of the second tube, both said barrier and said stop having small enough thickness that neither will interfere with the insertion of the second tube into the interior of said first tube, said barrier being affixed near the end of said first tube opposite from the end attached to said separator yoke and said stop being affixed near the end of said second tube which is first inserted into said first tube, the positioning of said stop and said barrier being adapted so that rotation of the second tube on its linear axis will position the stop so that it may pass the said barrier on partial withdrawal of the second tube from the first tube and then upon further rotation in either direction the stop may be positioned so that movement of the second tube back into the first tube will be stopped by contact of the said stop with the said barrier.

5. The device of claim 4 in which said first tube has at the end opposite from that attached to said separator yoke a lip portion extending inwardly and adapted to block the complete removal of the said second tube from the interior of said first tube by contact with the said stop on the exterior of said second tube.

6. The device of claim 5 in which the said lip has a notched section whereby rotation of the said second tube on its linear axis will allow the said stop to pass through the notched section of said lip.

* * * * *